US008430675B2

(12) United States Patent
Hardy et al.

(10) Patent No.: US 8,430,675 B2
(45) Date of Patent: Apr. 30, 2013

(54) EDGE MOUNT ELECTRICAL CONNECTOR

(75) Inventors: Douglas John Hardy, Middletown, PA (US); John Wesley Hall, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 21 days.

(21) Appl. No.: 13/168,132

(22) Filed: Jun. 24, 2011

(65) Prior Publication Data

US 2012/0329298 A1 Dec. 27, 2012

(51) Int. Cl.
*H01R 12/00* (2006.01)

(52) U.S. Cl.
USPC ..... 439/63; 439/607.36

(58) Field of Classification Search ..... 439/63, 439/581, 607.4, 607.35, 607.36
See application file for complete search history.

(56) References Cited

U.S. PATENT DOCUMENTS

| | | | | |
|---|---|---|---|---|
| 4,509,811 | A * | 4/1985 | Amano et al. | 439/77 |
| 4,913,664 | A * | 4/1990 | Dixon et al. | 439/607.28 |
| 5,046,952 | A * | 9/1991 | Cohen et al. | 439/63 |
| 5,273,460 | A * | 12/1993 | Arai | 439/607.17 |
| 5,547,400 | A * | 8/1996 | Wright | 439/668 |
| 6,109,966 | A * | 8/2000 | Chiou | 439/607.03 |
| 6,227,904 | B1 * | 5/2001 | Wang et al. | 439/541.5 |
| 6,386,888 | B1 * | 5/2002 | Skopic et al. | 439/63 |
| 6,447,311 | B1 * | 9/2002 | Hu et al. | 439/108 |
| 6,482,045 | B2 * | 11/2002 | Arai | 439/680 |
| 7,008,266 | B2 * | 3/2006 | Fang | 439/607.35 |
| 7,086,867 | B2 * | 8/2006 | Nakagawa et al. | 439/63 |
| 7,086,901 | B2 * | 8/2006 | Zhang | 439/607.56 |
| 7,204,720 | B1 * | 4/2007 | Shiu | 439/668 |
| 7,547,217 | B1 * | 6/2009 | Lin | 439/76.1 |
| 7,597,583 | B2 * | 10/2009 | Zhuang | 439/490 |
| 7,604,513 | B2 * | 10/2009 | Wang et al. | 439/668 |
| 7,927,108 | B2 * | 4/2011 | Gong et al. | 439/63 |
| 8,162,672 | B2 * | 4/2012 | Huang | 439/63 |
| 2003/0203658 | A1 * | 10/2003 | Zhao et al. | 439/63 |
| 2007/0111555 | A1 * | 5/2007 | Neumetzler | 439/63 |
| 2009/0215315 | A1 * | 8/2009 | Cheng | 439/607.28 |
| 2011/0143603 | A1 * | 6/2011 | Huang et al. | 439/675 |

OTHER PUBLICATIONS

Drawing No. C-1670861, Assembly FAKRA PCB 1POS, Jack, Right Angled, Rev. D2, Dec. 28, 2006, 3 pgs, TE Connectivity.
Drawing No. C-1670607, Assembly FAKRA PCB 2POS, Jack, Right Angled, Rev. E, Oct. 4, 2006, 3 pgs, Tyco Electronics.

* cited by examiner

*Primary Examiner* — Neil Abrams

(57) ABSTRACT

An electrical connector is provided including a coaxial connector sub-assembly having a stamped and formed outer contact. A dielectric insert is positioned within the outer contact. A center contact extends through the dielectric insert. A ground contact tab extends from the connector sub-assembly and is configured to ground to a substrate. The ground contact tab is configured for one of through-hole mounting or surface mounting to the substrate by selective bending of the ground contact tab. An interface housing receives the connector sub-assembly. A rear housing is coupled to the interface housing. The connector sub-assembly is captured between the interface housing and the rear housing. The rear housing is coupled to the substrate to secure the interface housing to the substrate. The rear housing is configured for one of through-hole mounting or surface mounting to the substrate.

20 Claims, 8 Drawing Sheets

EDGE MOUNT ELECTRICAL CONNECTOR

BACKGROUND OF THE INVENTION

The subject matter described herein relates to an edge mount electrical connector for a substrate.

Generally, electronic devices include substrates, for example, circuit boards having a plurality of electronic components positioned thereon to carry out various functions of the electronic device. Typically, the substrates include various connectors joined thereto. The connectors may be configured to receive a cable from another substrate and/or a cable from another electronic device. The cables enable the substrate to transmit and/or receive power and/or data signals from the other substrate and/or electronic device. Some connectors include an inner contact for providing a signal circuit, an outer contact for providing a return or ground circuit, and a ground contact tab for grounding the connector to the substrate. Often, the connector may be edge-mounted to the substrate so that a mating interface of the connector extends from the substrate.

Conventional edge-mounted connectors are not without their disadvantages. In particular, edge-mount connectors are generally die cast as a single unit. However, die casting the connectors prohibits the connectors from being color coded. This may be problematic in configuring the connector to mate with a mating connector that may have one of several different keying features. When all of the connectors are formed in the same color, it may be difficult to select a connector having desired keying features. Additionally, the substrate may be configured for surface mounting the connector or through-hole mounting the connector. Generally, die-cast connectors are formed in one of a surface mount configuration or a through-hole mount configuration. Typically, it is difficult to adjust a die for either through-hole mounting or surface mounting. Accordingly, multiple molds must be used when creating die cast connectors. Moreover, die casting is generally expensive. The need for multiple dies casts increases the costs associated with manufacturing the connectors.

A need remains for an edge mount connector that can be formed for surface mounting or through-hole mounting without the need for multiple die casts. Another need remains for an edge mount connector that can be color coded based on the keying features of the connector.

SUMMARY OF THE INVENTION

In one embodiment, an electrical connector is provided including a connector sub-assembly having a stamped and formed outer contact. A dielectric insert is positioned within the outer contact. A center contact extends through the dielectric insert. A ground contact tab extends from the connector sub-assembly and is configured to ground to a substrate. The ground contact tab is configured for one of through-hole mounting or surface mounting to the substrate. An interface housing receives the connector sub-assembly. A rear housing is coupled to the interface housing. The connector sub-assembly is captured between the interface housing and the rear housing. The rear housing is coupled to the substrate to secure the interface housing to the substrate. The rear housing is configured for one of through-hole mounting or surface mounting to the substrate.

In another embodiment, an electrical connector is provided including an interface housing for receiving a connector sub-assembly. A rear housing is coupled to the interface housing. The connector sub-assembly is captured between the interface housing and the rear housing. The rear housing is configured to be coupled to a substrate to secure the interface housing to the substrate. The rear housing is configured for one of through-hole mounting or surface mounting to the substrate. A ground clip is provided having coupling mechanisms to secure the interface housing to the rear housing. The ground clip has a ground surface to ground the connector to a chassis of an electronic device.

In another embodiment, an electrical connector is provide including a connector sub-assembly having a stamped and formed outer contact. A dielectric insert is positioned within the outer contact. A center contact extends through the dielectric insert. A ground contact extends from the connector sub-assembly and is configured to ground to a substrate. The ground contact is moveable to a first position to be through-hole mounted to the substrate. The ground contact is moveable to a second position that is different from the first position to be surface mounted to the substrate. An interface housing receives the connector sub-assembly. The interface housing has keying features to join to another connector. The interface housing is interchangeable with other interface housings having different keying features. A rear housing is coupled to the interface housing. The connector sub-assembly is captured between the interface housing and the rear housing. The rear housing is coupled to the substrate to secure the interface housing to the substrate. A ground clip is provided having coupling mechanisms to secure the interface housing to the rear housing.

BRIEF DESCRIPTION OF THE DRAWINGS

The presently disclosed subject matter will be better understood from reading the following description of non-limiting embodiments, with reference to the attached drawings, wherein below.

DETAILED DESCRIPTION OF THE INVENTION

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

The various embodiments provide an electrical connector, for edge mounting to a substrate, having a two-piece housing that allows for both surface mounting and through-hole mounting of the connector to the substrate. The two-piece housing includes an interface housing and a rear housing. The interface housing and the rear housing may be formed from plastic and enable the interface housing and the rear housing to be formed for one of surface mounting or through-hole mounting to a substrate of an electronic device. The housings retain a connector sub-assembly that is grounded to the substrate through at least one of ground pads or a through-hole mounted post. In one embodiment, a ground clip helps secure the interface housing to the rear housing. The ground clip may include a ground surface for grounding the connector to a chassis of the electronic device.

Figure 1:
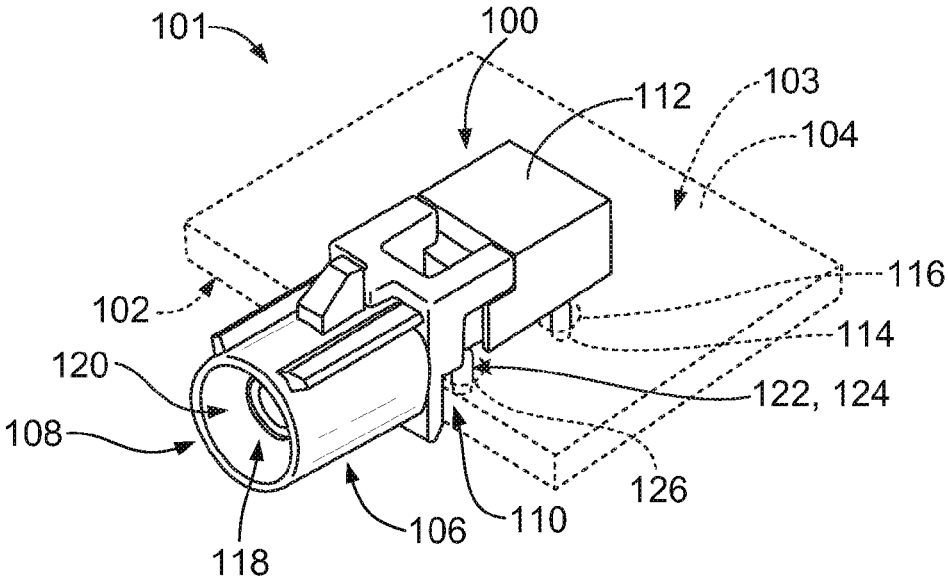
FIG. 1 is a top perspective view of a substrate assembly formed in accordance with an exemplary embodiment.

FIG. 1 is a top perspective view of a substrate assembly 101 formed in accordance with an exemplary embodiment. The assembly 101 includes an electrical connector 100 formed in accordance with an exemplary embodiment. In the illustrated embodiment, the electrical connector 100 is a FAKRA connector. Alternatively, the electrical connector 100 may be any suitable electrical connector. The electrical connector 100 is mounted to an edge 102 of a substrate 104. The substrate 104 may be a circuit board, for example, a printed circuit board. The substrate 104 may be a motherboard, daughter card, back plane circuit board, midplane circuit board, or the like. The substrate 104 may be part of an electronic device (not shown). The substrate 104 may be configured with electrical components (not shown) of the electronic device. The electrical connector 100 is configured to receive a mating connector from another substrate and/or from another electronic device. The electrical connector 100 is electrically coupled to the substrate to transmit and/or receive power and/or data signals between the other substrate and/or electronic device and the electrical components of the electronic device.

As shown in FIG. 1, the connector 100 comprises an interface housing 106, a rear housing 112 and a connector subassembly 118. The interface housing 106 includes a mating end 108 and a flange 110. The flange 110 is positioned on a top surface 103 of the substrate 104 at the edge 102 of the substrate so that the mating end 108 of the interface housing 106 extends past the edge 102. In the illustrated embodiment, the flange 110 of the interface housing 106 is not directly coupled to the substrate 104. Rather, the flange 110 of the interface housing 106 in merely positioned on the substrate 104. In an alternative embodiment, the flange 110 of the interface housing 106 may include coupling mechanisms to secure the interface housing 106 to the substrate 104. The mating end 108 of the interface housing 106 is configured to receive the mating connector. In an exemplary embodiment, the mating end 108 of the interface housing 106 may include keying features that correspond to keying features of the mating connector. In one embodiment, the interface housing 106 may be interchangeable with other interface housings 106 having different keying features.

The rear housing 112 is positioned proximate to the edge 102 of the substrate 104. The rear housing 112 is joined to the interface housing 106. The rear housing 112 is coupled to the substrate 104 to secure the interface housing 106 to the substrate 104. In the illustrated embodiment, the rear housing 112 includes posts 114 that is through-hole mounted through a rear housing aperture 116 of the substrate 104. The posts 114 are received in the rear housing aperture 116 through an interference fit to retain the rear housing 112 on the substrate 104. In other embodiments, the rear housing 112 may include any suitable mechanism for securing to the substrate 104. The posts 114 may also protrude through aperture 116 without an interference fit.

The connector sub-assembly 118 (shown in more detail in FIG. 4A-4C) is positioned within the interface housing 106. The connector sub-assembly 118 is captured within the connector 100 between the interface housing 106 and the rear housing 112. A mating end 120 of the connector sub-assembly 118 extends through the mating end 108 of the interface housing 106. The mating end 120 of the connector sub-assembly 118 is configured to engage the mating connector. The connector sub-assembly 118 also includes a ground contact tab 122. In the illustrated embodiment, the ground contact tab 122 is formed as a ground post 124 (shown in more detail in FIG. 4B). The ground post 124 is received within a ground aperture 126 of the substrate 104 to ground the connector 100 to the substrate 104.

In one embodiment, the connector 100 may also include additional retention features to secure the interface housing 106 to the rear housing 112. For example, the connector 100 may include a ground clip, as described below.

Figure 2:
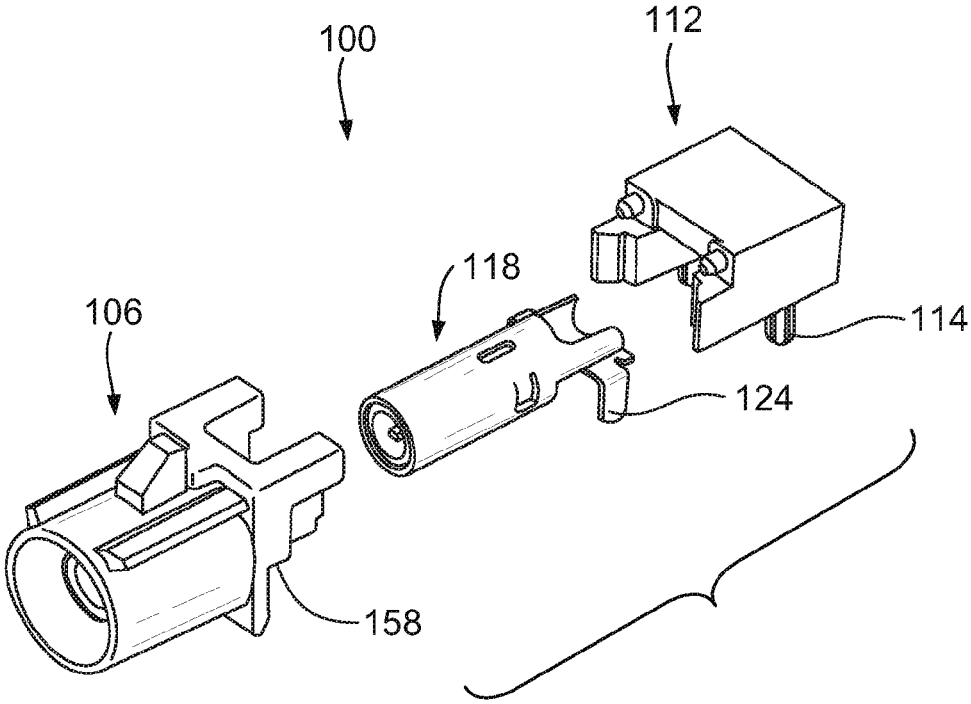
FIG. 2 is an exploded top perspective view of an electrical connector formed in accordance with an exemplary embodiment and configured for through-hole mounting to a substrate.

FIG. 2 is an exploded top perspective view of the electrical connector 100 formed in accordance with an exemplary embodiment for through-hole mounting to the substrate 104 (shown in FIG. 1). The connector sub-assembly 118 is configured to be received within the interface housing 106. The rear housing 112 is configured to be secured to the interface housing 106 so that the connector sub-assembly 118 is captured between the interface housing 106 and the rear housing 112. The connector sub-assembly 118 and the rear housing 112 are aligned with the interface housing 106 so that the ground posts 124 of the connector sub-assembly 118 and the posts 114 of the rear housing 112 extend beyond a substrate surface 158 of the interface housing 106. Accordingly, when the substrate surface 158 is positioned on the substrate 104, the ground posts 124 and the posts 114 are received in the ground apertures 126 and the rear housing apertures 116 (both shown in FIG. 1), respectively, of the substrate 104.

Figure 3A:
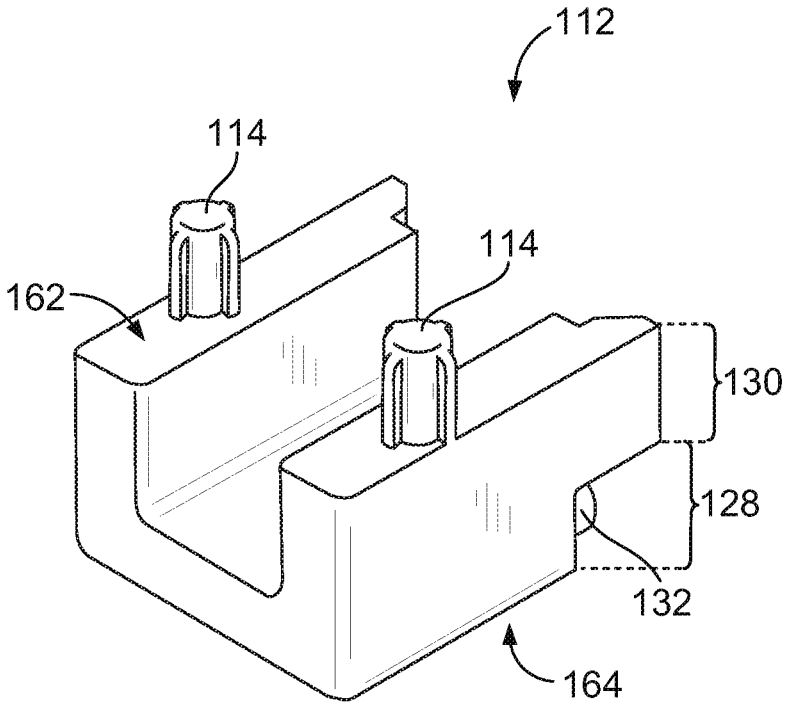
FIG. 3A is a bottom perspective view of a rear housing formed in accordance with an embodiment and configured for through-hole mounting to a substrate.

FIG. 3A is a bottom perspective view of the rear housing 112. The rear housing illustrated in FIG. 2 is configured to be through-hole mounted into the substrate 104 (shown in FIG. 1). FIG. 3A illustrates the rear housing 112 as is shown in FIG. 2. The rear housing 112 includes an upper portion 128 and a lower portion 130. The upper portion 128 includes retention features 132. The retention features 132 are configured to be coupled to corresponding retention features 134 (shown in FIG. 5) formed in the interface housing 106 (shown in FIG. 1). In the illustrated embodiment, the retention features 132 are formed as posts that are received in the retention features 134. Alternatively, the retention features 134 may be formed as posts that are received in the retention features 132. The retention features 132 and 134 may be retained together through an interference fit. Posts 114 extend from a bottom 162 of the rear housing 112. The retention features 132 extend from the rear housing 112 proximate to a top 164 of the rear housing 112.

Figure 3B:
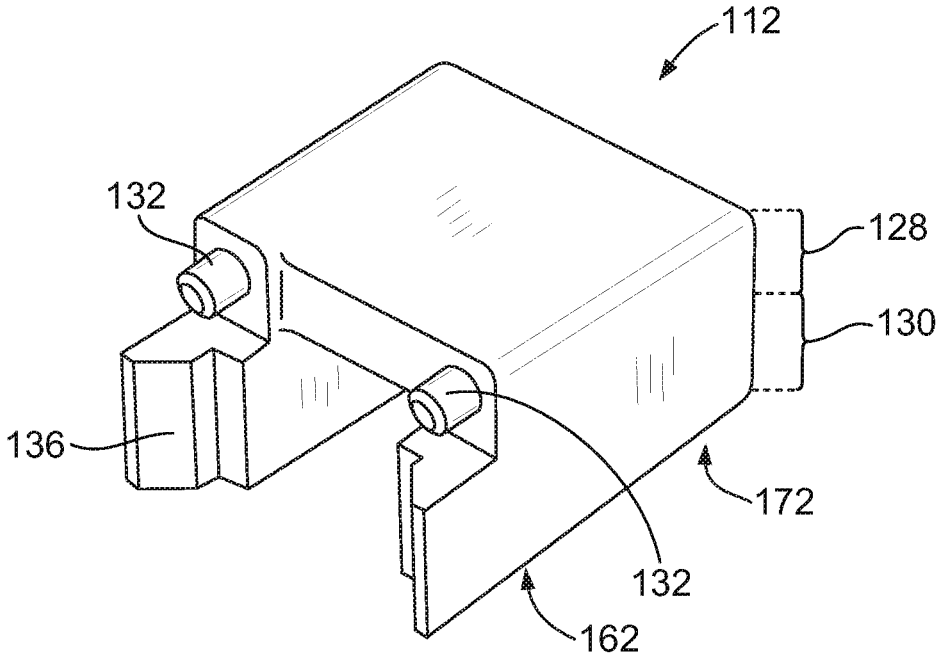
FIG. 3B is a top perspective view of a rear housing formed in accordance with an embodiment and configured for surface mounting to a substrate.
Figure 6:
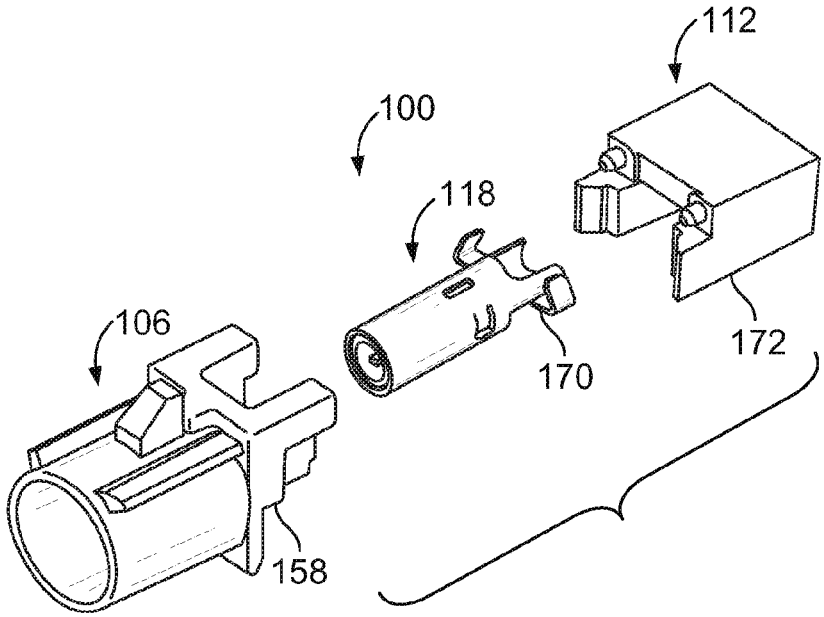
FIG. 6 is an exploded top perspective view of the electrical connector formed in accordance with another exemplary embodiment and configured to be surface mounted to a substrate.

FIG. 3B illustrates an alternative embodiment of the rear housing 112 that is configured to be surface mounted to the substrate 104 (shown in FIG. 1). The connector 100 (shown in FIG. 1) can be formed with either the embodiment of the rear housing 112 shown in FIG. 2 or the embodiment of the rear housing shown in FIG. 3 depending on the application of the connector 100 (e.g. whether the connector is configured to be through-hole mounted or surface mounted). FIG. 3B illustrates the rear housing 112 as is shown in FIG. 6. A mounting surface 172 extends along the bottom 162 of the rear housing 112. When the connector 100 is coupled to the substrate 104, the mounting surface 172 is configured to abut the top surface 103 (shown in FIG. 1) of the substrate 104. The mounting surface 172 may be secured to the substrate 104 with glue, an epoxy, or the like. The mounting surface 172 is secured to the substrate 104 to retain the electrical connector 100 (shown in FIG. 1) on the substrate 104.

The retention features 132 extend from the top portion 128 of the rear housing. The lower portion 130 of the rear housing 112 includes an angled flange 136. The angled flange 136 corresponds to an angled flange 138 (shown in FIG. 5) formed on the interface housing 106. The angled flanges 136 and 138 are configured to align the interface housing 106 with the rear housing 112. It should be noted that, although not illustrated in FIG. 2, the embodiment of the rear housing 112 shown in FIG. 2 also includes the angled flange 136.

Figure 4A:
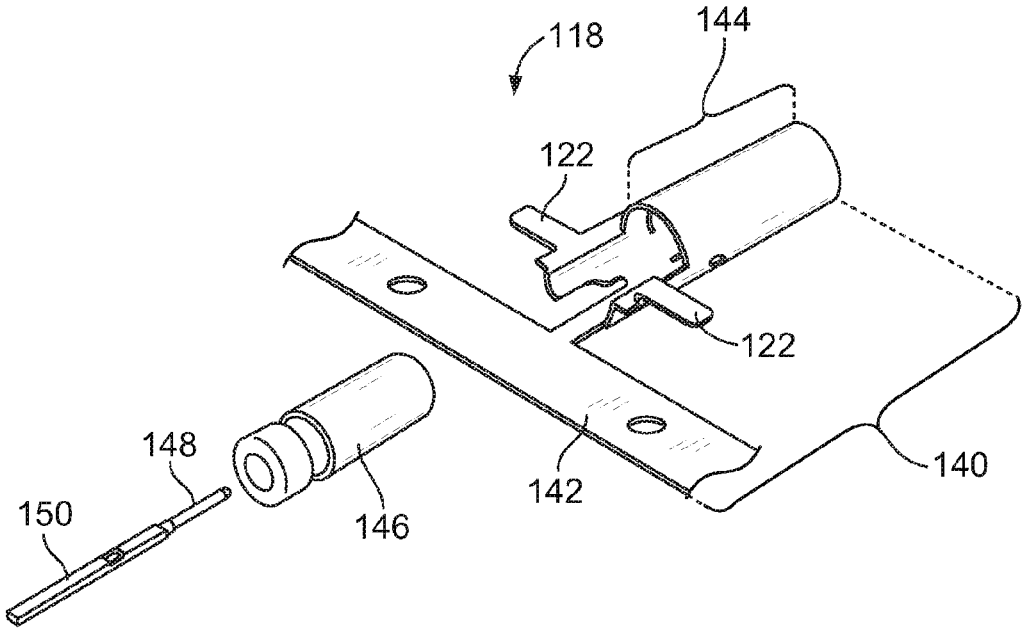
FIG. 4A is an exploded view of a connector sub-assembly during forming.
Figure 4B:
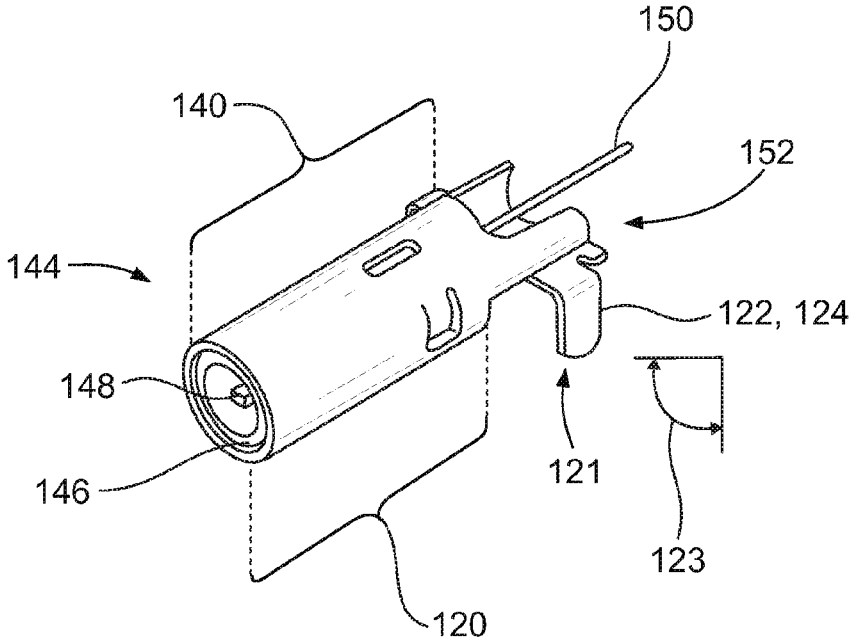
FIG. 4B is a top perspective view of a connector sub-assembly formed in accordance with an exemplary embodiment and configured to be through-hole mounted to a substrate.
Figure 4C:
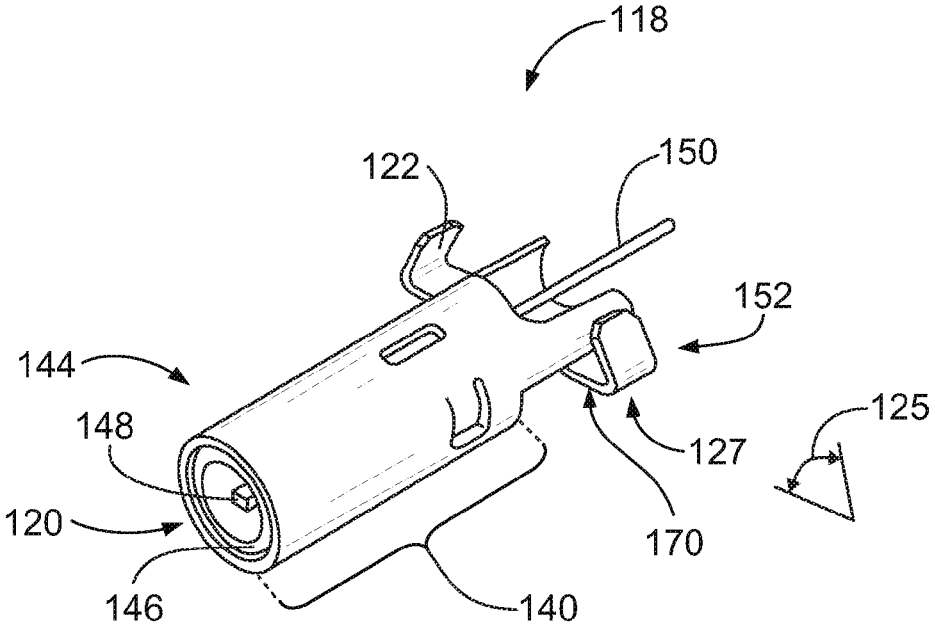
FIG. 4C is a top perspective view of a connector sub-assembly formed in accordance with an exemplary embodiment and configured to be surface mounted to a substrate.

FIG. 4A is an exploded view of a connector sub-assembly 118 during forming. The connector sub-assembly 118 includes an outer contact 140. The outer contact 140 may be stamped and formed. For example, in the illustrated embodiment, the outer contact 140 is stamped and formed on a carrier strip 142. The outer contact is configured to be removed from the carrier strip 142 prior to being inserted into the connector 100 (shown in FIG. 1). A mating portion 144 of the outer contact 140 is rolled into a barrel to form a portion of the mating end 120 (shown in FIG. 1) of the connector sub-assembly 118. The outer contact 140 includes ground contact tabs 122 that are configured to ground the connector 100 to the substrate 104 (shown in FIG. 1). The ground contact tabs 122 are illustrated in a pre-assembled form. The ground contact tabs 122 may be formed for through-hole mounting to the substrate 104, as shown in FIG. 4B, or for surface mounting to the substrate 104, as shown in FIG. 4C. Accordingly, a single stamped and formed connector sub-assembly 118 may be configured for through-hole mounting or surface mounting.

A dielectric insert 146 is configured to be received in the mating portion 144. The dielectric insert 146 receives a center contact 148 that is insulated from the mating portion 144 by the dielectric insert 146. The center contact 148 forms a portion of the mating end 120 of the connector sub-assembly 118. A wire 150 extends from the center contact 148. The wire 150 may be coupled to the substrate 104 (shown in FIG. 1), another connector, and/or an electronic component that may be positioned on the substrate 104.

FIG. 4B is a top perspective view of a connector sub-assembly 118 formed in accordance with an exemplary embodiment and configured to be through-hole mounted to the substrate 104 (shown in FIG. 1). FIG. 4B illustrates the connector sub-assembly 118 as is shown in FIG. 2. The dielectric insert 146 is positioned within the mating end 144 of the outer contact 140. The center contact 148 is positioned within the dielectric insert 146 and extends axially through the outer contact 140. The outer contact 140, the dielectric insert 146 and the center contact 148 form the mating end 120 of the connector sub-assembly 118. The wire 150 extends from a wire end 152 of the connector sub-assembly 118. In the illustrated embodiment, the ground contact tabs 122 are bent downward to a first position 121 to form ground posts 124 that may be through-hole mounted in the ground aperture 126 (shown in FIG. 1) of the substrate 104. The ground contact tabs 122 are bent at an angle 123 to form the ground posts 124.

FIG. 4C is a top perspective view of a connector sub-assembly 118 formed in accordance with another exemplary embodiment and configured to be surface mounted to the substrate 104 (shown in FIG. 1). FIG. 4C illustrates the connector sub-assembly 118 as is shown in FIG. 6. The dielectric insert 146 is positioned within the mating end 144 of the outer contact 140. The center contact 148 is positioned within the dielectric insert 146 and extends axially through the outer contact 140. The outer contact 140, the dielectric insert 146 and the center contact 148 form the mating end 120 of the connector sub-assembly 118. The wire 150 extends from a wire end 152 of the connector sub-assembly 118. In the illustrated embodiment, the ground contact tabs 122 are bent upward to a second position 127 to form ground surfaces 170 that may be surface mounted to the substrate 104 (shown in FIG. 1). The second position 127 is different than the first position 121 (shown in FIG. 4B). The ground contact tabs 122 are bent upward at an angle 125 to form the ground surfaces 170. In an exemplary embodiment, the angle 125 is different than the angle 123 (shown in FIG. 4). The angle 125 is also opposite the angle 123. The ground surfaces 170 are configured to be surface mounted to ground pads (not shown) that replace the ground apertures 126 (shown in FIG. 1) of the substrate 104. The ground surfaces 170 may be soldered to the ground pads of the substrate 104. Alternatively, the substrate 104 may include ground springs (not shown) that engage the ground surfaces 170, when the electrical connector 100 (shown in FIG. 1) is positioned on the substrate 104.

Figure 5:
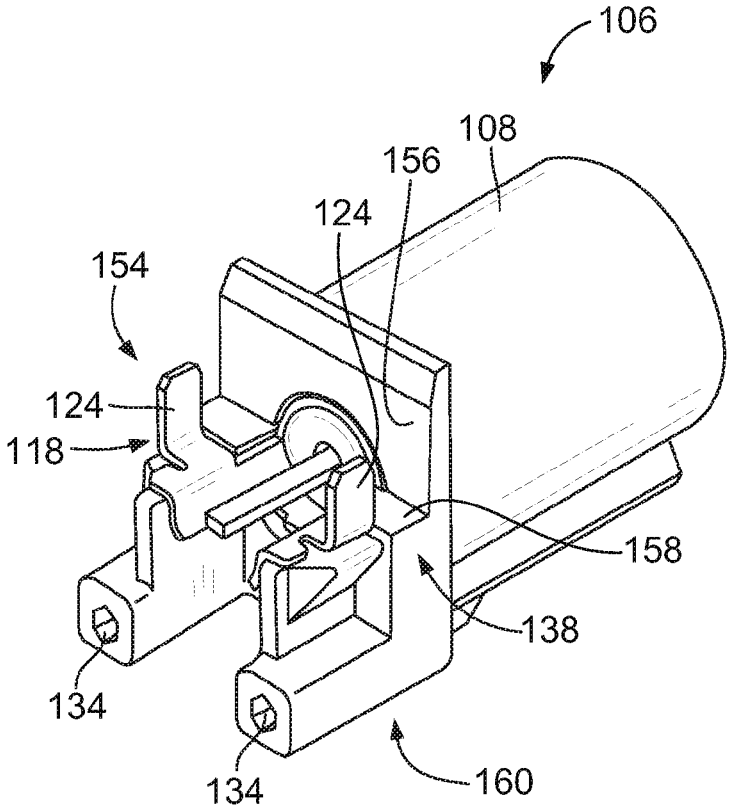
FIG. 5 is a bottom perspective view of an interface housing having a connector sub-assembly coupled thereto and configured for through-hole mounting to a substrate.

FIG. 5 is a bottom perspective view of the interface housing 106 having the connector sub-assembly 118 coupled thereto. The sub-assembly 118 illustrated in FIG. 5 is configured as shown in FIG. 4B. The mating end 120 (shown in FIG. 1) of the connector sub-assembly 118 is positioned within the mating end 108 of the interface housing 106. The wire 150 extends outward from the mating end 108 of the interface housing 106. The ground posts 124 extend toward a bottom 154 of the interface housing 106. The ground posts 124 are configured to be received in the ground apertures 126 of the substrate 104 (both shown in FIG. 1), when the interface housing 106 is joined to the substrate 104.

The interface housing 106 includes an edge surface 156. The edge surface 156 is configured to abut the edge 102 (shown in FIG. 1) of the substrate 104, when the interface housing 106 is positioned on the substrate 104. The interface housing 106 also includes a substrate surface 158 that is configured to abut the top surface 103 (shown in FIG. 1) of the substrate 104, when the interface housing 106 is positioned on the substrate 104. The ground posts 124 extend past the substrate surface 158 so that the ground posts 124 may be received within the ground apertures 126 (shown in FIG. 1) of the substrate 104.

The angled flanges 138 are positioned proximate to a top 160 of the interface housing 106. The angled flanges 138 are configured to mate with the angled flanges 136 of the rear housing 112 (shown in FIG. 2) to align the rear housing 112 and the interface housing 106. The retention features 134 are positioned proximate to the top 160 of the interface housing 106 to engage the retention features 132 (shown in FIGS. 3A and 3B) of the rear housing 112.

FIG. 6 is an exploded top perspective view of the electrical connector 100 formed in accordance with another exemplary embodiment and configured to be surface mounted to the substrate 104 (shown in FIG. 1). The electrical connector 100 includes the interface housing 106, the embodiment of the rear housing 112 shown in FIG. 3B, and the embodiment of the connector sub-assembly 118 shown in FIG. 4C. The connector sub-assembly 118 is configured to be received within the interface housing 106. The rear housing 112 is configured to be secured to the interface housing 106 so that the connector sub-assembly 118 is captured between the interface housing 106 and the rear housing 112. The connector sub-assembly 118 and the rear housing 112 are aligned with the interface housing 106 so that the ground surface 170 of the connector sub-assembly 118 and the mounting surface 172 of the rear housing 112 are substantially flush with the substrate surface 158 of the interface housing 106. Accordingly, when the substrate surface 158 is positioned on the substrate 104, the ground surface 170 and the mounting surface 172 abut the top surface 103 (shown in FIG. 1) of the substrate 104.

It should be noted that in some embodiments the ground posts 124 of the connector sub-assembly 118 may be utilized with the mounting surfaces 172 of the rear housing 112. Alternatively, the ground surfaces 172 of the connector sub-assembly 118 may be utilized with the posts 114 of the rear housing 112. Accordingly, the connector 100 can be configured with multiple mating interfaces and can provide space savings and the ability to have various distances between mating interfaces. The connector is also formed with interchangeable parts to enable various different interface housings 106 to be coupled to a rear housing 112 and a connector sub-assembly 118 configured for through-hole mounting or surface mounting.

Figure 7:
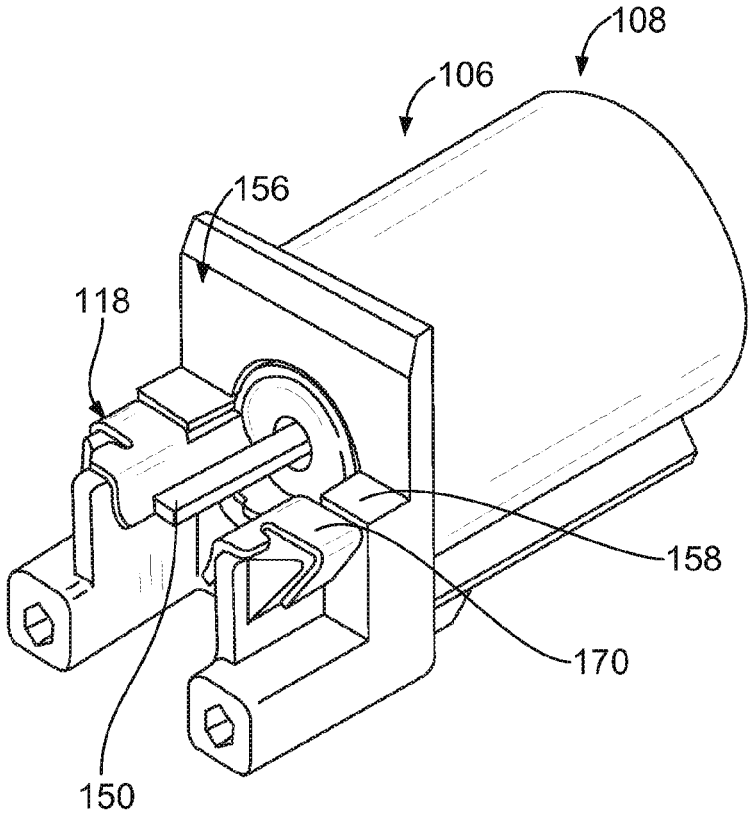
FIG. 7 is a bottom perspective view of an interface housing having a connector sub-assembly coupled thereto and configured for surface mounting to a substrate.

FIG. 7 is a bottom perspective view of the interface housing 106 having the connector sub-assembly 118 coupled thereto. The sub-assembly 118 illustrated in FIG. 7 is configured as shown in FIG. 4C. The mating end 120 (shown in FIG. 1) of the connector sub-assembly 118 is positioned within the mating end 108 of the interface housing 106. The wire 150 extends outward from the mating end 108 of the interface housing 106. The interface housing 106 includes the edge surface 156 that is configured to abut the edge 102 (shown in FIG. 1) of the substrate 104. The interface housing 106 also includes the substrate surface 158 that is configured to abut the top surface 103 of the substrate 104. In the illustrated embodiment, the ground surfaces 170 of the connector sub-assembly 118 are substantially flush with the substrate surface 158 of the interface housing 106 so that the ground surfaces 170 may abut the ground pads and/or ground springs of the substrate 104.

Figure 8:
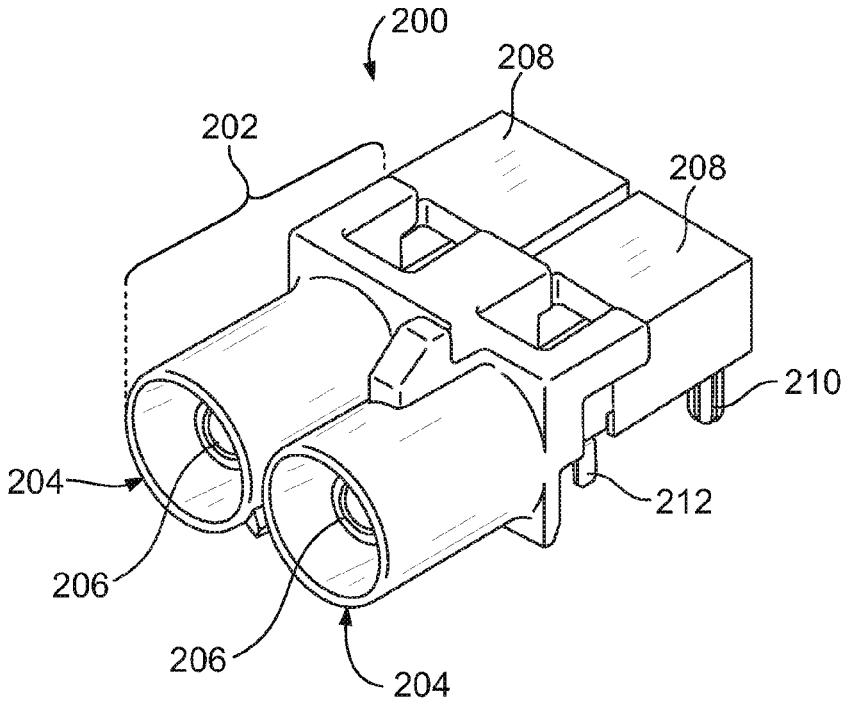
FIG. 8 is a top perspective view of an electrical connector formed in accordance with another exemplary embodiment.

FIG. 8 is a top perspective view of an electrical connector 200 formed in accordance with another exemplary embodiment. The electrical connector 200 includes an interface housing 202 having a pair of mating ends 204. Each mating end 204 includes a connector sub-assembly 206. Each connector sub-assembly 206 and corresponding mating end 204 is configured to receive a separate mating connector (not shown). Accordingly, the electrical connector 200 is configured to receive two mating connectors. Alternatively, the electrical connector 200 may be configured to receive any number of mating connectors. Rear housings 208 are coupled to the interface housing 202. In the illustrated embodiment, two rear housings 208 are provided. Each rear housing 208 secures a mating connector sub-assembly 206 within the electrical connector 200.

In the illustrated embodiment, the rear housings 208 include posts 210 for through-hole mounting the rear housings 208 to a substrate (not shown). Likewise, the connector sub-assemblies 206 include ground posts 212 configured to be through-hole mounted into the substrate. Alternatively, the electrical connector 200 may include ground surfaces on the connector sub-assemblies 206 and/or mounting surfaces on the rear housings 208. In one embodiment, the electrical connector 200 may utilize any combination of ground posts 212, posts 210, ground surfaces, and/or mounting surfaces.

Figure 9:
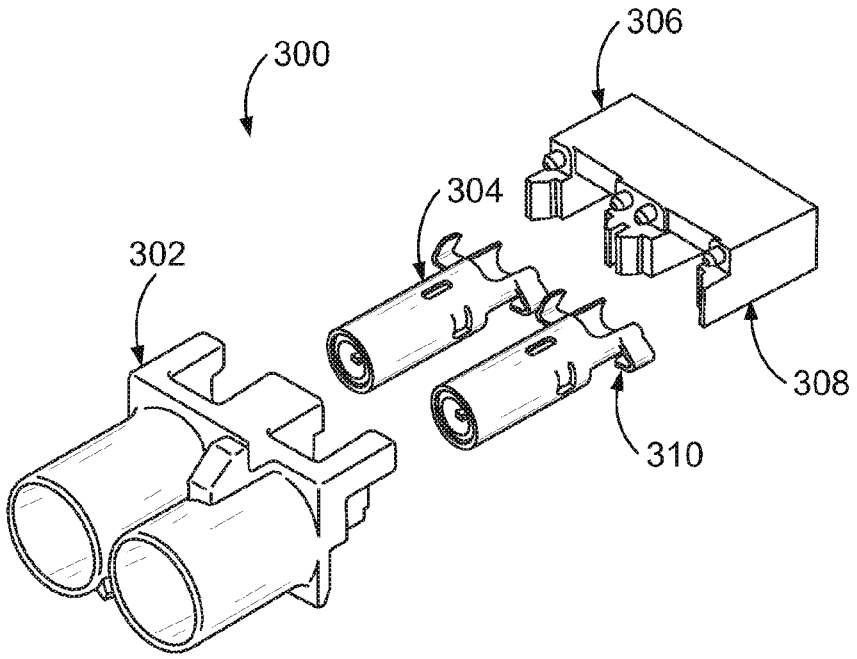
FIG. 9 is an exploded top perspective view of an electrical connector formed in accordance with another exemplary embodiment.

FIG. 9 is an exploded top perspective view of an electrical connector 300 formed in accordance with another exemplary embodiment. The electrical connector 300 includes an interface housing 302 configured to receive two connector sub-assemblies 304. Optionally, the interface housing 302 may be configured to receive any number of connector sub-assemblies 304. A single rear housing 306 is configured to join to the interface housing 302 to secure the connector sub-assemblies 304.

In the illustrated embodiment, the rear housing 306 includes a mounting surface 308 for surface mounting the rear housing 306 to a substrate (not shown). Likewise, the connector sub-assemblies 304 include ground surfaces 310 configured to be surface mounted into the substrate. Alternatively, the electrical connector 300 may include ground posts on the connector sub-assemblies 304 and/or posts on the rear housing 306. In one embodiment, the electrical connector 300 may utilize any combination of ground posts, posts, ground surfaces 310, and/or mounting surfaces 308.

Figure 10:
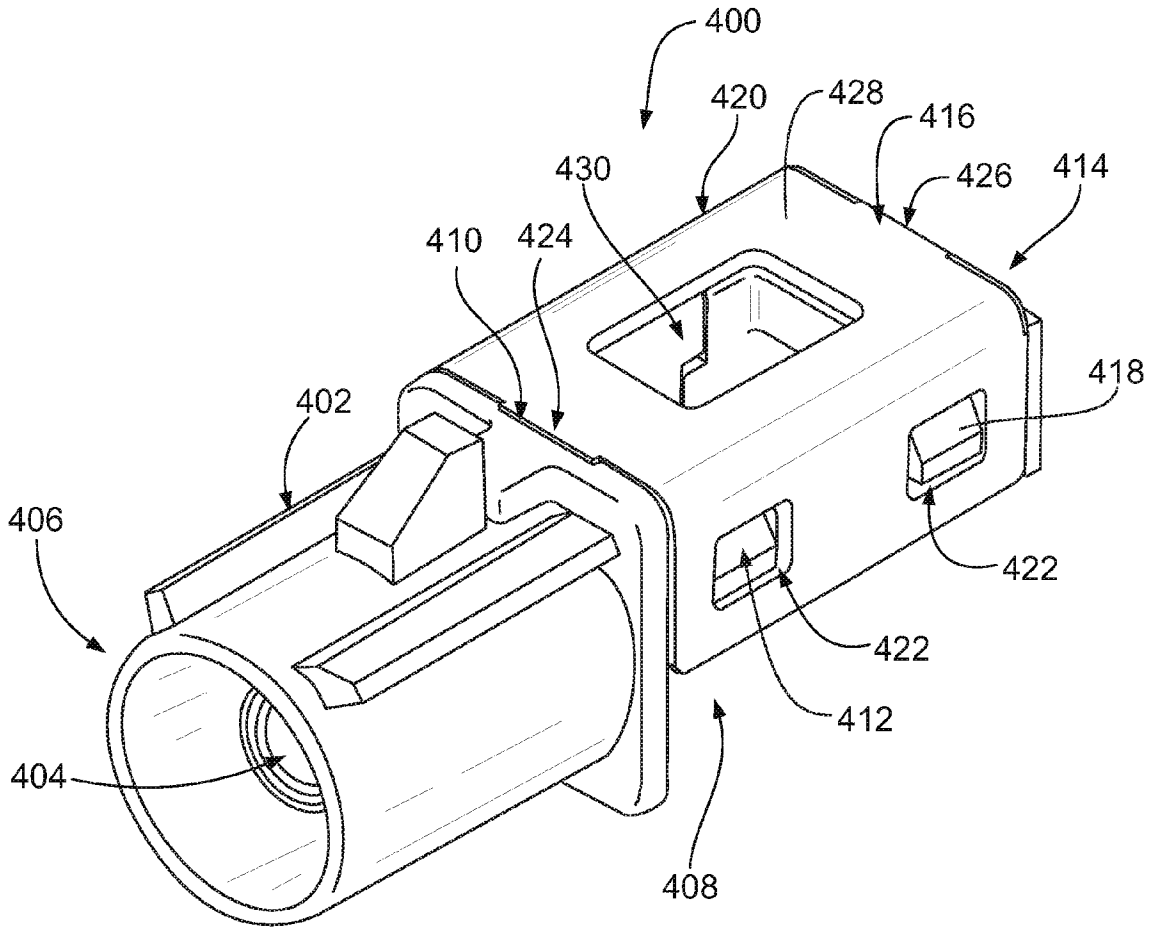
FIG. 10 is a top perspective view of an electrical connector formed in accordance with another exemplary embodiment.

FIG. 10 is a top perspective view of an electrical connector 400 formed in accordance with another exemplary embodiment. The electrical connector 400 includes an interface housing 402 having a connector sub-assembly 404 positioned within a mating end 406 thereof. A substrate end 408 is configured to be positioned on a substrate (not shown). The substrate end 408 includes a slot 410 and coupling mechanisms 412.

A rear housing 414 is joined to the interface housing 402 to secure the connector sub-assembly 404 within the electrical connector 400. The rear housing 414 includes a slot 416 and coupling mechanisms 418. It should be noted that both the rear housing 414 and the connector sub-assembly 404 may be configured to be surface mounted and/or through-hole mounted to the substrate, as described above.

A ground clip 420 is positioned over the substrate end 408 of the interface housing 402 and the rear housing 414. The ground clip 420 includes coupling mechanisms 422 that receive the corresponding coupling mechanisms 412 and 418 of the interface housing 402 and the rear housing 414, respectively. In the illustrated embodiment, the coupling mechanisms 412 and 418 are formed as protrusions and the coupling mechanisms 422 are formed as openings configured to receive the coupling mechanisms 412 and 418. Optionally, the coupling mechanisms 412 and 418 may be formed as openings and the coupling mechanisms 422 may be formed as protrusions configured to be received in the coupling mechanisms 412 and 418. Alternatively, the coupling mechanisms 412, 418, and 422 may be formed as any corresponding coupling mechanisms.

The coupling mechanisms 412, 418, and 422 are configured to secure the interface housing 402 to the rear housing 414. For example, the ground clip 420 may facilitate preventing the interface housing 402 from separating from the rear housing 414 if a force, for example, a shear force is applied to the interface housing 402. The ground clip 420 may facilitate a stronger bond between the interface housing 402 and the substrate.

The ground clip 420 also includes an interface housing flange 424 and a rear housing flange 426. The interface housing flange 424 is received in the slot 410 of the interface housing 402. The rear housing flange 426 is received in the slot 416 of the rear housing 414. The flanges 424 and 426 are snapped into the respective slots 410 and 416 to further secure the ground clip 420 to the interface housing 402 and the rear housing 414.

The ground clip 420 also includes a ground surface 428. The ground surface 428 is configured to abut a chassis (not shown) of the electronic device in which the electrical connector 400 is positioned. For example, the ground surface 428 may directly abut the chassis. Alternatively, the chassis may include a ground spring (not shown) or the like that engages the ground surface 428. The ground surface 428 grounds the electrical connector 400 to the chassis of the electronic device. In one embodiment, grounding the electrical connector 400 to the chassis of the electronic device limits and/or prevents stray electromagnetic interference between the electrical connector 400 and other electrical components of the electronic device. In one embodiment, the connector sub-assembly 404 may also be ground to the substrate with a ground post and/or ground surface, as described above.

In the illustrated embodiment, an opening 430 is provided in the ground clip 420. The opening 430 extends through the ground surface 428. In one embodiment, the opening 430 provides access for soldering a center contact of the connector sub-assembly 404 to a wire or the like. The opening 430 may also provide access for inspecting a solder joint of the center contact. In one embodiment, the opening 430 enables heat to escape the electrical connector 400 either during soldering and/or operation.

Figure 11:
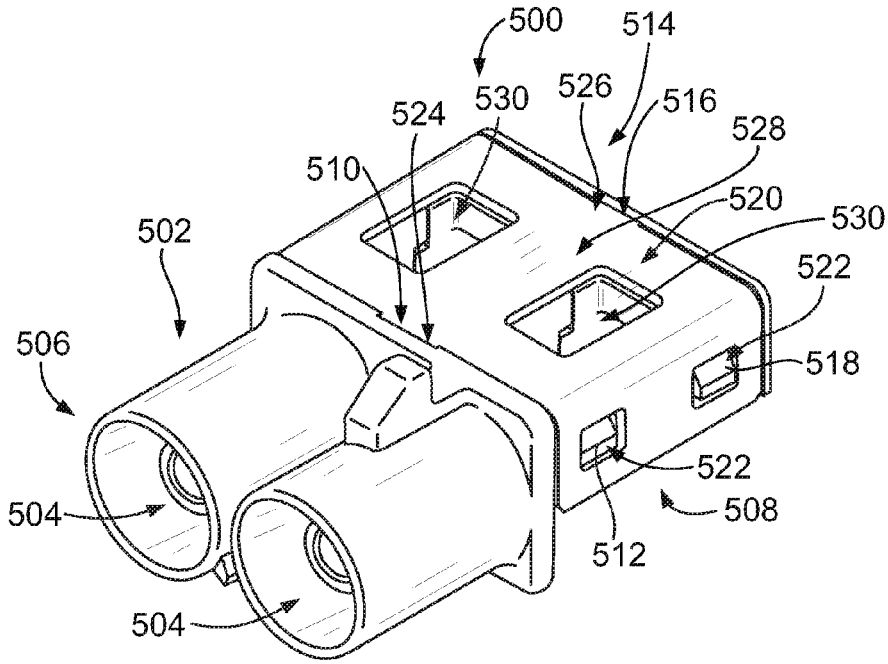
FIG. 11 is a top perspective view of an electrical connector formed in accordance with another exemplary embodiment.

FIG. 11 is a top perspective view of an electrical connector 500 formed in accordance with another exemplary embodiment. The electrical connector 500 includes an interface housing 502 having a two connector sub-assemblies 504 positioned within a mating end 506 thereof. Alternatively, the interface housing 502 may include any number of connector sub-assemblies 504. A substrate end 508 includes a slot 510 and coupling mechanisms 512. A rear housing 514 is joined to the interface housing 502 and includes a slot 516 and coupling mechanisms 518.

A ground clip 520 is positioned over the interface housing 502 and the rear housing 514. The ground clip 520 includes coupling mechanisms 522 that receive the corresponding coupling mechanisms 512 and 518 of the interface housing 502 and the rear housing 514, respectively. The coupling mechanisms 512, 518, and 522 are configured to secure the interface housing 502 to the rear housing 514. For example, the ground clip 520 may facilitate preventing the interface housing 502 from separating from the rear housing 514 if a force, for example, a shear force is applied to the interface housing 502.

The ground clip 520 also includes an interface housing flange 524 and a rear housing flange 526. The interface housing flange 524 is received in the slot 510 of the interface housing 502. The rear housing flange 526 is received in the slot 516 of the rear housing 514. The flanges 524 and 526 are snapped into the respective slots 510 and 516 to further secure the ground clip 520 to the interface housing 502 and the rear housing 514.

The ground clip 520 also includes a ground surface 528 configured to abut a chassis (not shown) of the electronic device in which the electrical connector 500 is positioned to ground the electrical connector 500 to the chassis of the electronic device. In one embodiment, grounding the electrical connector 500 to the chassis of the electronic device limits and/or prevents stray electromagnetic interference between the electrical connector 500 and other electrical components of the electronic device.

In the illustrated embodiment, openings 530 are provided in the ground clip 520 to provide access for soldering a center contact of the connector sub-assemblies 504 to a wire or the like. The openings 530 may also provide access for inspecting a solder joint of the center contact. In one embodiment, the openings 530 enable heat to escape the electrical connector 500 either during soldering and/or operation.

Figure 12:
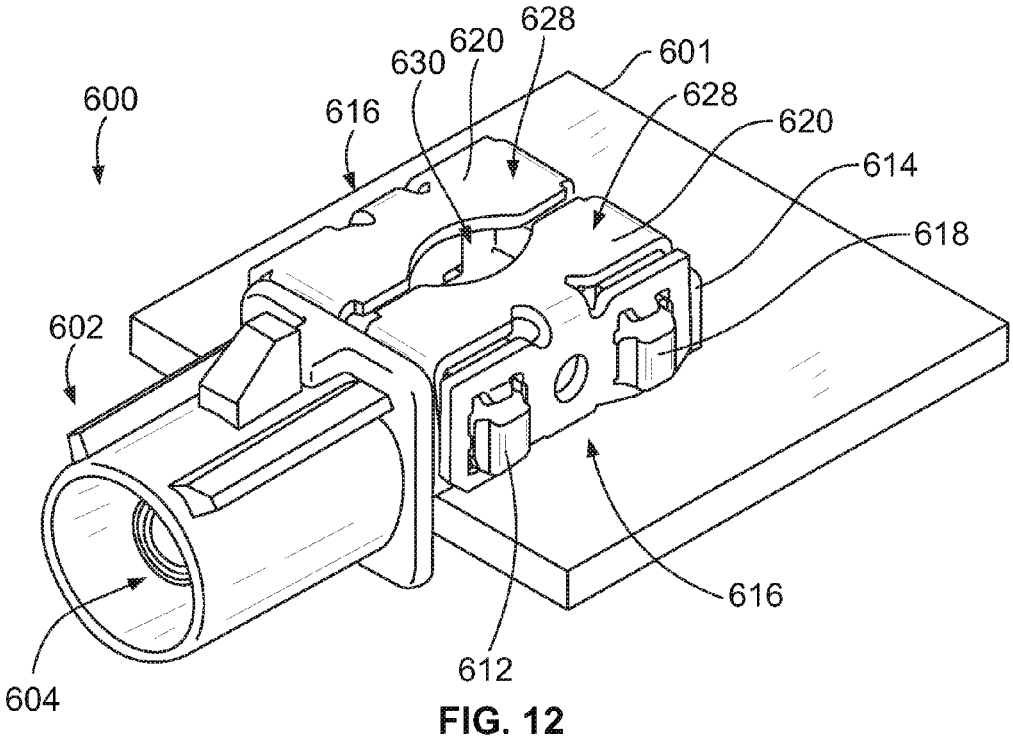
FIG. 12 is a top perspective view of an electrical connector formed in accordance with another exemplary embodiment

FIG. 12 is a top perspective view of an electrical connector 600 formed in accordance with another exemplary embodiment and joined to a substrate 601. The electrical connector 600 includes an interface housing 602 having a connector sub-assembly 604 positioned therein. The interface housing includes coupling mechanisms 612. A rear housing 614 is joined to the interface housing 602 and includes coupling mechanisms 618.

A pair of ground clips 620 is positioned over the interface housing 602 and the rear housing 614. Each ground clip 620 is joined to a respective side 616 of the electrical connector 600. The ground clips 620 include coupling mechanisms 622 that receive the corresponding coupling mechanisms 612 and 618 of the interface housing 602 and the rear housing 614, respectively. The coupling mechanisms 612, 618, and 622 are configured to secure the interface housing 602 to the rear housing 614. For example, the ground clips 620 may facilitate preventing the interface housing 602 from separating from the rear housing 614 if a force, for example, a shear force is applied to the interface housing 602.

The ground clips 620 include ground surfaces 628 that are configured to abut a chassis (not shown) of the electronic device in which the electrical connector 600 is positioned. The ground surfaces 628 ground the electrical connector 600 to the chassis of the electronic device to limit and/or prevent stray electromagnetic interference between the electrical connector 600 and other electrical components of the electronic device.

An opening 630 is provided between the ground clips 620. The opening 630 provides access for soldering a center contact of the connector sub-assembly 604 to a wire or the like. The opening 630 may also provide access for inspecting a solder joint of the center contact. In one embodiment, the opening 630 enables heat to escape the electrical connector 600 either during soldering and/or operation.

It should be noted that in any of the above embodiments, the interface housing may be color coded based on keying features of the interface housing. Moreover, the rear housing may be color coded based on the rear housing being surface mountable or through-hole mountable. The embodiments described provide an electrical connector having various interchangeable parts. The interface housing may be interchangeable based on the desired keying features of the connector. The rear housing may be interchangeable to provide surface mounting or through-hole mounting. Additionally, the connector sub-assembly is stamped and formed so that the sub-assembly is configurable for through-hole mounting or surface mounting.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. An electrical connector comprising:

a connector sub-assembly having a stamped and formed outer contact, a dielectric insert positioned within the outer contact, a center contact extending through the dielectric insert, a ground contact tab extending from the connector sub-assembly and configured to ground to a substrate, the ground contact tab positionable in a first orientation for through-hole mounting to the substrate and the ground contact tab positionable in a second orientation for surface mounting to the substrate;

an interface housing receiving the connector sub-assembly; and a rear housing coupled to the interface housing, the connector sub-assembly captured between the interface housing and the rear housing, the rear housing coupled to the substrate to secure the interface housing to the substrate, wherein the rear housing is configured for one of through-hole mounting or surface mounting to the substrate.

2. The electrical connector of claim 1, wherein the rear housing configured for through-hole mounting to the substrate comprises at least one post configurable to be received in one or more apertures of the substrate.

3. The electrical connector of claim 1, wherein the rear housing configured for surface mounting to the substrate comprises a mounting surface configured to abut a top surface of the substrate and couple to the top surface by at least one of solder, glue, and epoxy.

4. The electrical connector of claim 1, wherein in the first orientation, the ground contact tab of the connector sub-assembly is bent in a downward orientation as a ground post configured to be received in an aperture of the substrate when the electrical connector is mounted to the substrate.

5. The electrical connector of claim 1, wherein in the second orientation, a bottom portion of the ground contact tab of the connector sub-assembly comprises a ground surface oriented parallel to a plane defined by the substrate, the ground surface configured to be surface-mountable to the substrate.

6. The electrical connector of claim 1, wherein the ground contact tab is to be bent at a first angle in the first orientation to through-hole mount the ground contact tab to the substrate, the ground contact tab to be bent at a second angle that is different from the first angle in the second orientation to surface mount the ground contact tab to the substrate.

7. The electrical connector of claim 1, wherein the interface housing and the rear housing include corresponding retention features to secure the interface housing to the rear housing.

8. The electrical connector of claim 1, further comprising a ground clip to secure the interface housing to the rear housing, the interface housing and the rear housing having coupling mechanisms that are received in coupling mechanisms of the ground clip, the ground clip comprising a ground surface configured to ground the electrical connector to a chassis of an electronic device.

9. The electrical connector of claim 1 further comprising a ground clip to secure the interface housing to the rear housing, the ground clip comprising a ground surface and an opening extending through the ground surface, wherein the opening is configured to provide access for soldering and inspecting the center contact of the sub-assembly and to enable heat to dissipate from the electrical connector.

10. The electrical connector of claim 1, wherein the interface housing is interchangeable with other interface housings having different keying features.

11. The electrical connector of claim 1, wherein the rear housing is configured for through-hole mounting to the substrate, and wherein the rear housing is interchangeable with another rear housing that is configured for surface mounting to the substrate.

12. The electrical connector of claim 1, wherein in the second orientation, a bottom portion of the ground contact tab of the connector sub-assembly comprises a ground surface positioned substantially flush with a substrate surface of the interface housing and a mounting surface of the rear housing, the ground surface, substrate surface, and mounting surface all configured to abut a top surface of the substrate.

13. The electrical connector of claim 1, wherein in the second orientation, a bottom portion of the ground contact tab of the connector sub-assembly comprises a ground surface oriented parallel to a plane defined by the substrate and a distal portion of the ground contact tab is bent upwards relative to the ground surface to engage an angled flange on the interface housing.

14. An electrical connector comprising:

an interface housing for receiving a connector sub-assembly, the connector sub-assembly having a stamped and formed outer contact, a dielectric insert positioned within the outer contact, a center contact extending through the dielectric insert, a ground contact tab extending from the connector sub-assembly and configured to ground to a substrate, the ground contact tab positionable in a first orientation for through-hole mounting to the substrate and the ground contact tab positionable in a second orientation for surface mounting to the substrate;

a rear housing coupled to the interface housing, the connector sub-assembly captured between the interface housing and the rear housing, the rear housing configured to be coupled to a substrate to secure the interface housing to the substrate, the rear housing configured for one of through-hole mounting or surface mounting to the substrate; and a ground clip having coupling mechanisms to secure the interface housing to the rear housing, the ground clip having a ground surface to ground the connector to a chassis of an electronic device.

15. The electrical connector of claim 14, wherein the interface housing and the rear housing further comprise coupling mechanisms that are received in the coupling mechanisms of the ground clip.

16. The electrical connector of claim 14, wherein the interface housing is interchangeable with other interface housings having different keying features.

17. The electrical connector of claim 14, wherein the interface housing and the rear housing include corresponding retention features to secure the interface housing to the rear housing.

18. The electrical connector of claim 14, wherein the ground clip comprises an opening extending through the ground surface, wherein the opening is configured to provide access for soldering and inspecting the center contact of the connector sub-assembly and to enable heat to dissipate from the electrical connector.

19. An electrical connector comprising:

a connector sub-assembly having a stamped and formed outer contact, a dielectric insert positioned within the outer contact, a center contact extending through the dielectric insert, a ground contact tab extending from the connector sub-assembly and configured to ground to a substrate, the ground contact tab positionable in a first orientation for through-hole mounting to the substrate, the ground contact tab positionable in a second orientation that is different from the first orientation for surface mounting to the substrate;

an interface housing receiving the connector sub-assembly, the interface housing having keying features to join to another connector, the interface housing being interchangeable with other interface housings having different keying features;

a rear housing coupled to the interface housing, the connector sub-assembly captured between the interface housing and the rear housing, the rear housing coupled to the substrate to secure the interface housing to the substrate; and a ground clip having coupling mechanisms to secure the interface housing to the rear housing.

20. The electrical connector of claim 19, wherein the rear housing is configured to be one of through-hole mounted or surface mounted to the substrate.

* * * * *